US011168960B2

(12) United States Patent
Teetzel et al.

(10) Patent No.: US 11,168,960 B2
(45) Date of Patent: Nov. 9, 2021

(54) MODULAR UNDERWATER TORPEDO SYSTEM

(71) Applicant: Wilcox Industries Corp., Portsmouth, NH (US)

(72) Inventors: James W. Teetzel, Portsmouth, NH (US); David G. Kent, North Hampton, NH (US); John P. Bousquet, Rochester, NH (US); Christopher Jay Palmer, Holliston, MA (US)

(73) Assignee: Wilcox Industries Corp., Newington, NH (US)

( * ) Notice: Subject to any disclaimer, the term of this patent is extended or adjusted under 35 U.S.C. 154(b) by 22 days.

(21) Appl. No.: 16/739,805

(22) Filed: Jan. 10, 2020

(65) Prior Publication Data

US 2020/0182591 A1 Jun. 11, 2020

Related U.S. Application Data

(62) Division of application No. 15/951,752, filed on Apr. 12, 2018, now Pat. No. 10,539,397.

(60) Provisional application No. 62/484,664, filed on Apr. 12, 2017.

(51) Int. Cl.

| | |
|---|---|
| ***F41G 7/22*** | (2006.01) |
| ***F42B 19/01*** | (2006.01) |
| ***F41G 7/00*** | (2006.01) |

(52) U.S. Cl.

CPC ..... *F41G 7/2273* (2013.01); *F41G 7/007* (2013.01); *F42B 19/01* (2013.01); *F41G 7/226* (2013.01); *F41G 7/228* (2013.01); *F41G 7/2246* (2013.01); *F41G 7/2253* (2013.01); *F41G 7/2293* (2013.01)

(58) Field of Classification Search

CPC ..... F41G 7/2273; F41G 7/228; F41G 7/2293; F41G 7/007; F41G 7/2246; F41G 7/2253; F41G 7/226; F42B 19/01

USPC ..... 114/20.2

See application file for complete search history.

(56) References Cited

U.S. PATENT DOCUMENTS

| | | | | |
|---|---|---|---|---|
| 3,745,956 | A * | 7/1973 | Bertheas | F41G 7/228 114/23 |
| 3,756,538 | A | 9/1973 | McLean | |
| 3,779,194 | A | 12/1973 | Kahn | |
| 3,853,081 | A | 12/1974 | Daudelin et al. | |
| 4,016,815 | A | 4/1977 | Bjork et al. | |
| 4,056,058 | A | 11/1977 | Laguna de Rins | |
| 4,359,957 | A | 11/1982 | Schnabel | |
| 4,360,348 | A | 11/1982 | DeMarco | |
| 4,369,709 | A | 1/1983 | Backstein et al. | |
| 4,637,213 | A | 1/1987 | Lobell et al. | |

(Continued)

*Primary Examiner* — Michelle Clement

(74) *Attorney, Agent, or Firm* — McLane Middleton, Professional Association

(57) ABSTRACT

A torpedo apparatus comprises a propulsion module operable to propel the torpedo apparatus through water and a steering module operatively coupled to the propulsion module. The steering module including a plurality of fins which are controllable for controlling a direction of travel of the torpedo apparatus through water. A plurality of head modules are removably and interchangeably attachable to the torpedo apparatus, wherein each of the head modules houses at least one guidance assembly and at least one utility assembly. A power supply module is configured to provide power to the propulsion module, the steering module, and an attached one of the head modules.

17 Claims, 8 Drawing Sheets

(56) References Cited

U.S. PATENT DOCUMENTS 4,648,322 A 3/1987 Heitz et al.
4,690,085 A 9/1987 Dobbs
4,732,100 A 3/1988 Dobbs
5,267,841 A 12/1993 Culp et al.
5,416,319 A 5/1995 Messina
5,708,232 A 1/1998 Nedderman, Jr.
5,737,962 A 4/1998 Turner et al.
5,834,467 A 11/1998 Rodriguez et al.
5,834,674 A * 11/1998 Rodriguez ..... F41F 3/10 89/1.81
6,032,460 A 3/2000 Pahl
6,163,372 A * 12/2000 Sallee ..... G01S 17/66 356/5.1
6,302,355 B1 * 10/2001 Sallee ..... F41G 7/2226 244/3.15
6,368,276 B1 * 4/2002 Bullis ..... A61B 8/00 600/437
6,802,260 B2 10/2004 Woodall et al.
6,832,740 B1 12/2004 Ransom
7,250,568 B1 7/2007 Dow et al.
7,966,936 B1 6/2011 Gieseke
8,015,922 B2 9/2011 Fu
8,072,172 B2 12/2011 Hanlon et al.
10,957,336 B2 * 3/2021 Short ..... G01S 3/8006
2002/0126577 A1 * 9/2002 Borchardt ..... G01S 15/87 367/88
2003/0005872 A1 * 1/2003 DePoy, II ..... G01S 3/86 114/21.3
2004/0065247 A1 * 4/2004 Horton ..... B63G 8/001 114/322
2004/0226280 A1 11/2004 Berg et al.
2010/0153050 A1 * 6/2010 Zumberge ..... G01V 7/16 702/92
2012/0289103 A1 11/2012 Hudson et al.
2015/0176955 A1 6/2015 Slotta et al.
2018/0290717 A1 * 10/2018 Byrd ..... B63C 11/52

* cited by examiner

MODULAR UNDERWATER TORPEDO SYSTEM

CROSS-REFERENCE TO RELATED APPLICATION

This application is a divisional of U.S. Application Ser. No. 15/951,752 filed Apr. 12, 2018, now U.S. Pat. No. 10,539,397, which in turn claims the priority benefit of U.S. Provisional Application No. 62/484,664 filed Apr. 12, 2017. Each of the aforementioned applications is incorporated herein by reference in its entirety.

SUMMARY

The present disclosure relates generally to an underwater projectile system. In one aspect, a torpedo apparatus comprises a propulsion module operable to propel the torpedo apparatus through water. A steering module is operatively coupled to the propulsion module, the steering module including a plurality of fins which are controllable for controlling a direction of travel of the torpedo apparatus through water. A plurality of head modules are removably and interchangeably attachable to the torpedo apparatus, wherein each of the head modules houses at least one guidance assembly and at least one utility assembly. A power supply module is configured to provide power to the propulsion module, the steering module, and an attached one of the head modules.

In a more limited aspect, the guidance assembly includes an optical receiver for detecting light reflected from a target, the optical receiver cooperating with the steering module to direct the torpedo apparatus to the target.

In another more limited aspect, the guidance assembly is configured to follow an ultraviolet (UV) laser designator beam.

In yet another more limited aspect, the guidance assembly includes an acoustic transducer for detecting sound waves emanating from a target, the acoustic transducer cooperating with the steering module to direct the torpedo apparatus to the target.

In still another more limited aspect, the guidance assembly is configured to emit pulses of sound and detect return echoes.

In yet another more limited aspect, the pulses of sound have an ultrasonic frequency.

In yet another more limited aspect, the guidance assembly includes a magnetometer configured to detect variations in the Earth's magnetic field caused by a target, the magnetometer cooperating with the steering module to direct the torpedo apparatus to the target.

In yet another more limited aspect, the utility assembly includes a tracking device and a fastener for attaching the tracking device to a target vessel.

In yet another more limited aspect, the fastener is selected from the group consisting of a magnet, one or more darts, and one or hooks.

In yet another more limited aspect, the tracking device is selected from the group consisting of a radio frequency beacon, optical beacon, inertial device and a satellite-based positioning system tracking device.

In yet another more limited aspect, the fins are movable between a retracted state wherein the fins are retracted within a housing of the steering module and an extended state wherein the fins extend through openings within the housing of the steering module.

In yet another more limited aspect, the torpedo apparatus is configured to be fired by a conventional torpedo launch platform.

In yet another more limited aspect, one of the head modules includes a utility assembly comprising a housing enclosing a piston, the piston carrying an elongate charge of fuel/oxidizer mixture. A heat-producing component is attached to the charge of a fuel/oxidizer mixture and is configured to generate sufficient heat to initiate a fuel/oxidizer reaction upon impact with a vessel's hull. A plurality of legs are provided, each of the legs having a proximal end hingedly attached to the piston and a distal end opposite the proximal end. Each of the legs are movable between a retracted position and an extended position. The distal end of each leg has a fastener element operable to attach to the vessel's hull upon impact with the vessel's hull. A spring is disposed within the housing for biasing the piston toward the vessel's hull upon impact with and attachment to the vessel's hull.

In yet another more limited aspect, the fuel/oxidizer mixture is thermite.

In yet another more limited aspect, the heat-producing component is selected from the group consisting of an incendiary charge and a detonator.

In yet another more limited aspect, each leg is folded into a respective receptacle in the housing when the legs are in the folded position.

In yet another more limited aspect, the fastener elements are selected from group consisting of permanent magnets, darts, and hooks.

In another aspect, a torpedo apparatus comprises a propulsion module operable to propel the torpedo apparatus through water. A steering module is operatively coupled to the propulsion module, the steering module including a plurality of fins which are controllable for controlling a direction of travel of the torpedo apparatus through water. A head module is operatively coupled to the steering module, the head module including a housing enclosing a piston, the piston carrying an elongate charge of fuel/oxidizer mixture. A heat-producing component is attached to the charge of the fuel/oxidizer mixture and configured to generate sufficient heat to initiate a fuel/oxidizer reaction upon impact with a vessel's hull. A plurality of legs are provided, each of the legs having a proximal end hingedly attached to the piston and a distal end opposite the proximal end, and each of the legs movable between a retracted position and an extended position. The distal end of each leg has a fastener element operable to attach to the vessel's hull upon impact with the vessel's hull. A spring is disposed within the housing for biasing the piston toward the vessel's hull upon impact with and attachment to the vessel's hull. A power supply module is configured to provide power to the propulsion module, the steering module, and an attached one of the head modules.

In more limited aspect, the head module further includes a guidance assembly.

In another more limited aspect, the guidance assembly is selected from the group consisting of optical guidance assembly for detecting light reflected from a target and an acoustic guidance assembly for detecting sound waves emanating from a target.

In another aspect, a torpedo head module for a torpedo assembly comprises a housing enclosing a piston, the piston carrying an elongate charge of fuel/oxidizer mixture. A heat-producing component is attached to the charge of a fuel/oxidizer mixture and configured to generate sufficient heat to initiate a fuel/oxidizer reaction upon impact with a vessel's hull. A plurality of legs are provided, each of the legs having a proximal end hingedly attached to the piston and a distal end opposite the proximal end, and each of the legs movable between a retracted position and an extended position. The distal end of each leg has a fastener element operable to attach to the vessel's hull upon impact with the vessel's hull. A spring is disposed within the housing for biasing the piston toward the vessel's hull upon impact with and attachment to the vessel's hull.

In more limited aspect, the housing has a tapered outer shell construction shaped to reduce hydrodynamic resistance.

DETAILED DESCRIPTION OF THE PREFERRED EMBODIMENT(S)

Figure 1:
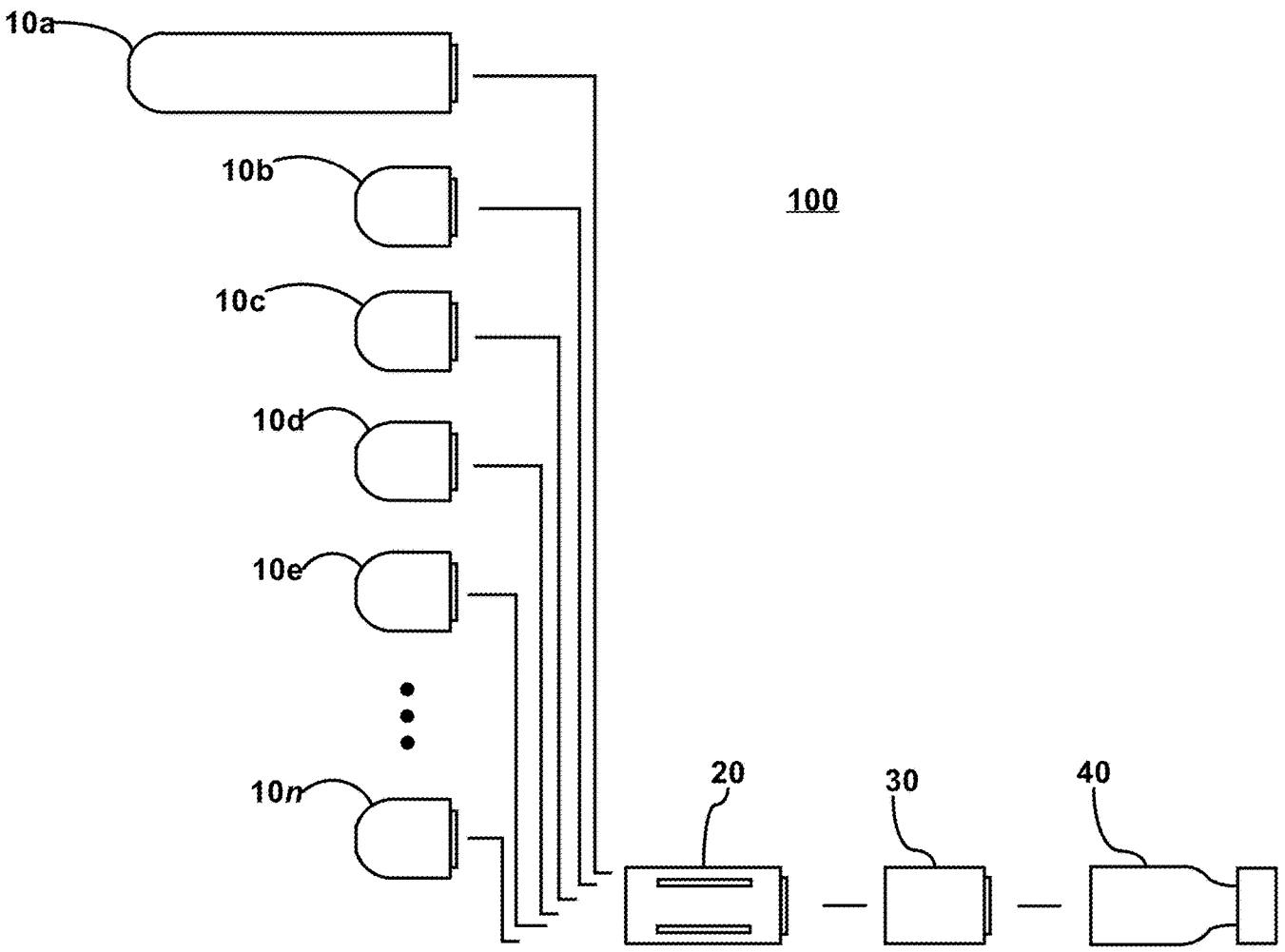
FIG. 1 is a schematic, exploded view of an exemplary modular torpedo system embodiment.
Figure 2:
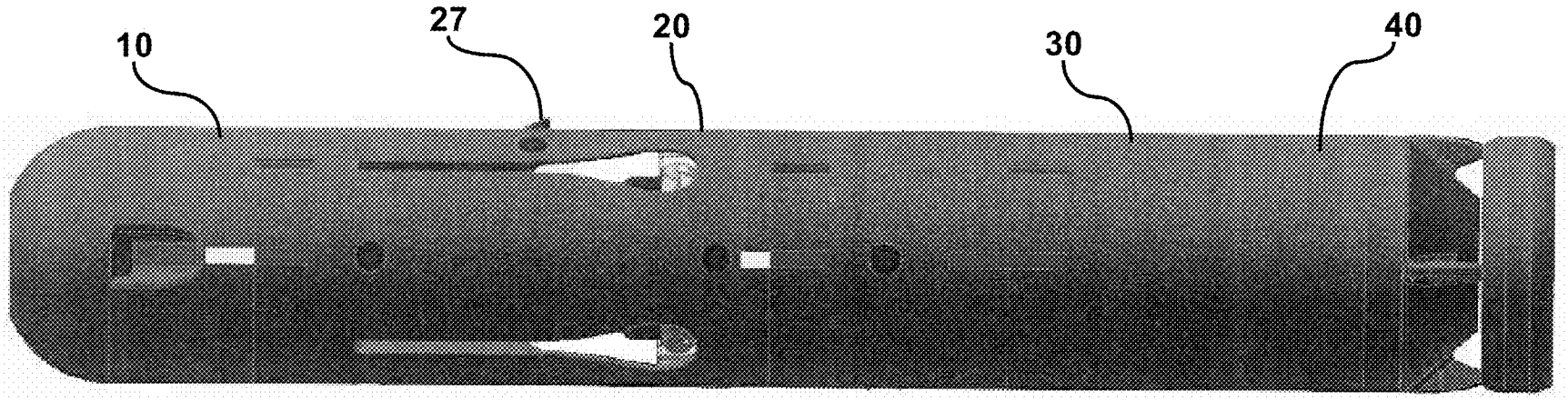
FIG. 2 is a side view of a first exemplary assembled torpedo apparatus.
Figure 3:
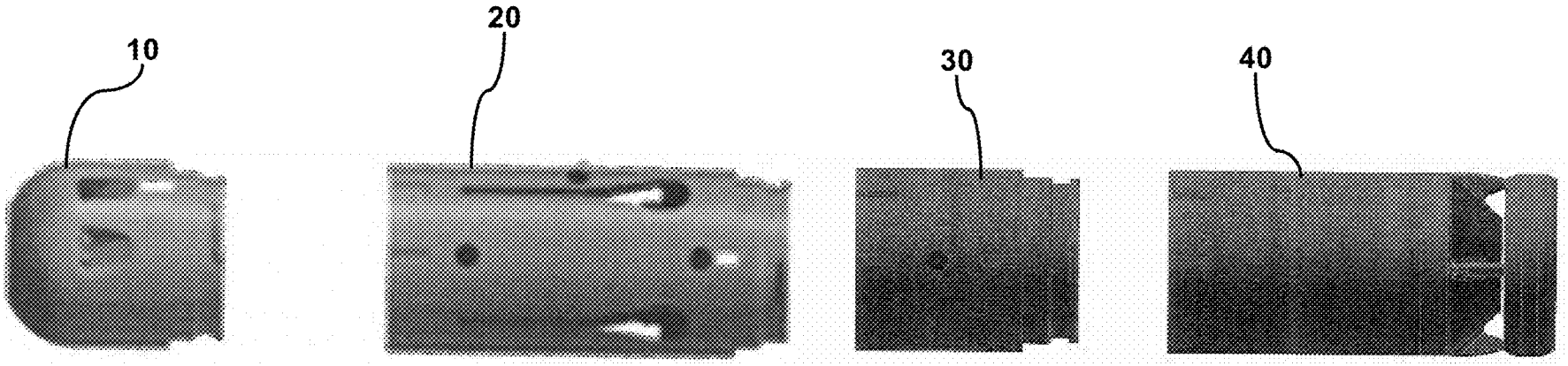
FIG. 3 is an exploded side view of the torpedo apparatus appearing in FIG. 2.
Figure 4:
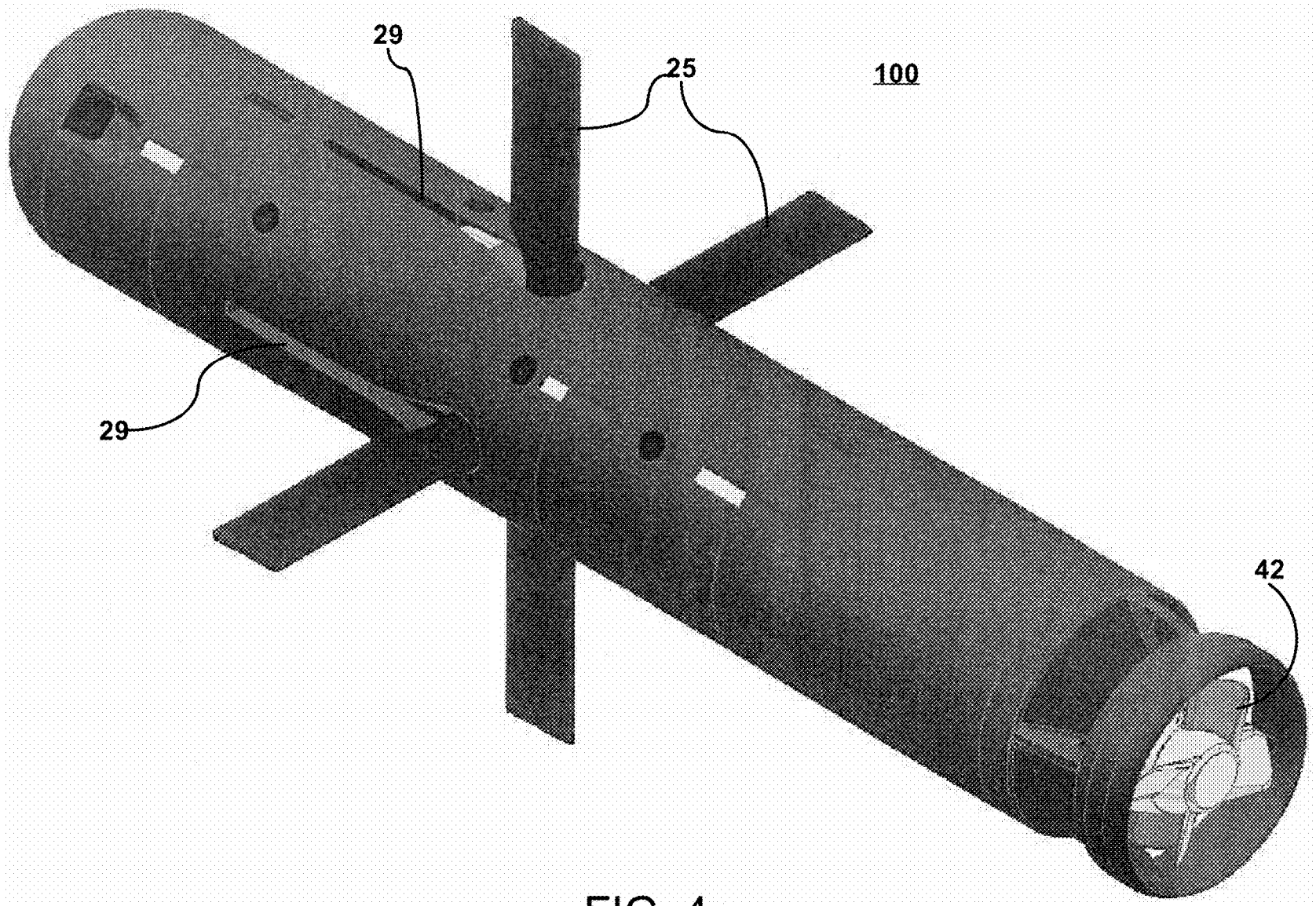
FIG. 4 is an isometric view of the torpedo apparatus appearing in FIG. 2, with the fins in the extended or deployed position.

Referring to FIGS. 1-4, there is shown an exemplary modular torpedo system, generally designated 100, which includes a head module 10, a steering control module 20, a power module 30, and a propulsion module 40. As illustrated, the head module 10 may be one of any of a number of interchangeable head modules 10*a* up to 10*n*, where n is any integer.

The interchangeable utility head module 10 includes a generally tapered outer shell construction shaped to minimize hydrodynamic resistance. Although certain embodiments are described herein as having certain features and functions, it is recognized that the head module may include any combination of two or more of such features and functions. In certain embodiments, the head module includes at least one guidance or seeker assembly or function and at least one utility assembly or function.

In certain embodiments, the head module 10 is a laser guided module 10*b*, having an optical receiver, sensor, camera, or the like to provide a laser spot seeking function, that is provided and configured to follow a laser designator or laser marker beam, e.g., a pulse encoded beam, under the guidance of the steering module 20. In certain embodiments, the laser designator beam is a UV laser. In operation, the target object is "painted" (marked) with a targeting beam, e.g., using a laser pointer or designator, which may be operated by the operator of the torpedo system or other personnel. In certain embodiments, the system is used in conjunction with a weapon mounted laser pointer/designator, which may be a part of a laser sight, laser range finder, weapon fire control system, or the like. In certain embodiments, the laser pointer may include a ballistics computer to assist the operator in firing the torpedo toward the target object.

In certain embodiments, the interchangeable head modules 10 includes a sub marker module 10*c*. The module 10*c* includes a tracking device and a fastener for attaching the tracking device below the waterline of a targeted vessel. The tracking device may be, for example, a radio frequency (RF) beacon configured to emit an RF signal which can tracked with a directional RF seeker, a satellite-based positioning receiver system (such as GPS, GNSS-2, GLOSNASS, and others) having a transmitter or transponder for transmitting geographic coordinates, inertial devices having a transmitter or transponder for transmitting position information, and the like.

In certain embodiments, the fastener is a permanent magnet, preferably as powerful magnet such as a rare earth (e.g., neodymium) magnet, for securing the tracking to a hull which is formed of iron, steel, or other a ferromagnetic material. In certain embodiments, the sub marker module 10*c* includes a magnetic head that allows the sub marker module 10*c* to attach to the hull of the ship or vehicle. For non-ferromagnetic hulls, such as wood or fiberglass hulls, the fastener element may comprise one or more darts or hooks.

In certain embodiments, the head module 10 is a magnetometer module 10*d* which includes a magnetometer for detecting variations in the earth's magnetic field caused by vessels such as ships or submarines having a ferromagnetic hull or otherwise having a substantial content of ferromagnetic materials. In certain embodiments, the magnetometer cooperates with the steering control module 20 to guide the torpedo toward the detected vessel.

In certain embodiments, the head module 10 is a noise seeker module 10*e*. In certain embodiments, the noise seeker module is an active noise seeker and includes an acoustic transducer for emitting pulses of sound (including ultrasound) and a microphone for detecting return echoes. In certain embodiments, the noise seeker module cooperates with the steering control module 20 to guide the torpedo toward the acoustically detected vessel. In certain embodiments, the noise seeker module is passive noise seeker and includes a microphone for detecting noise, such as engine noise, propeller noise, etc. for acoustically locating and steering the torpedo to a vessel in the vicinity.

Figure 5:
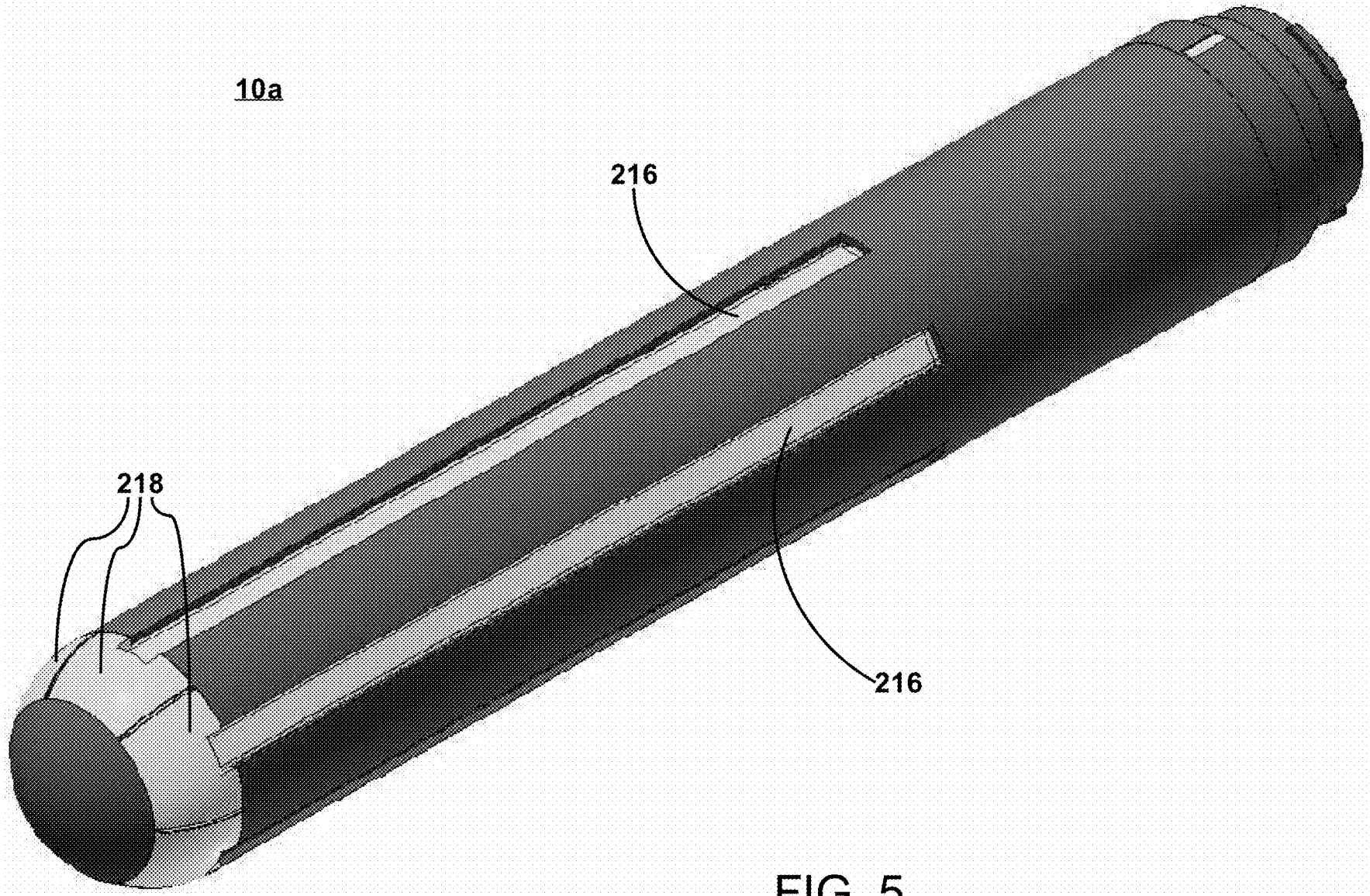
FIG. 5 is an isometric view of an exemplary torpedo head module carrying a charge of fuel/oxidizer mixture for breaching the hull of a vessel.
Figure 6:
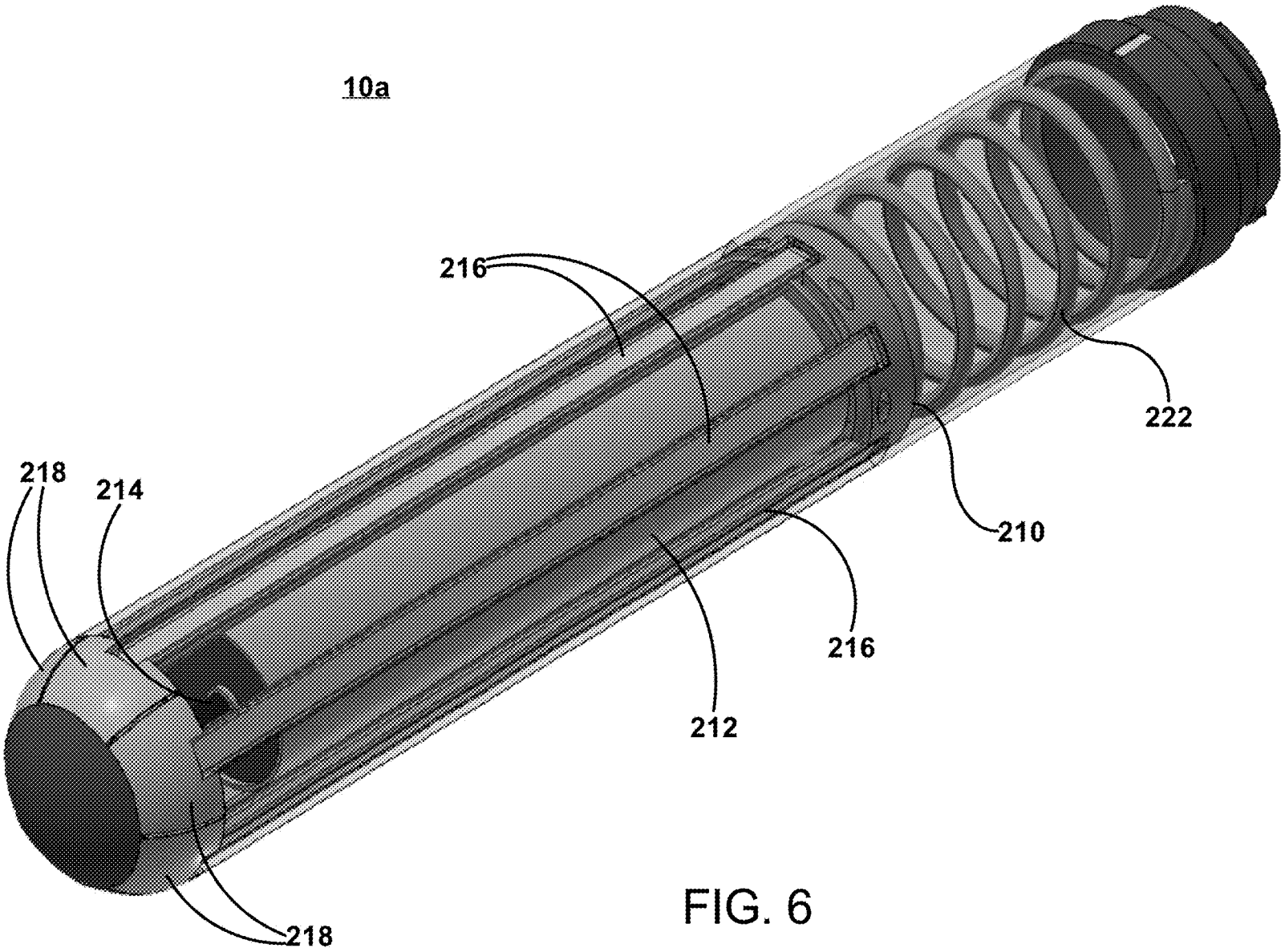
FIG. 6 is an isometric view of the torpedo head module appearing in FIG. 5, with a portion of the outer housing cut away.
Figure 7:
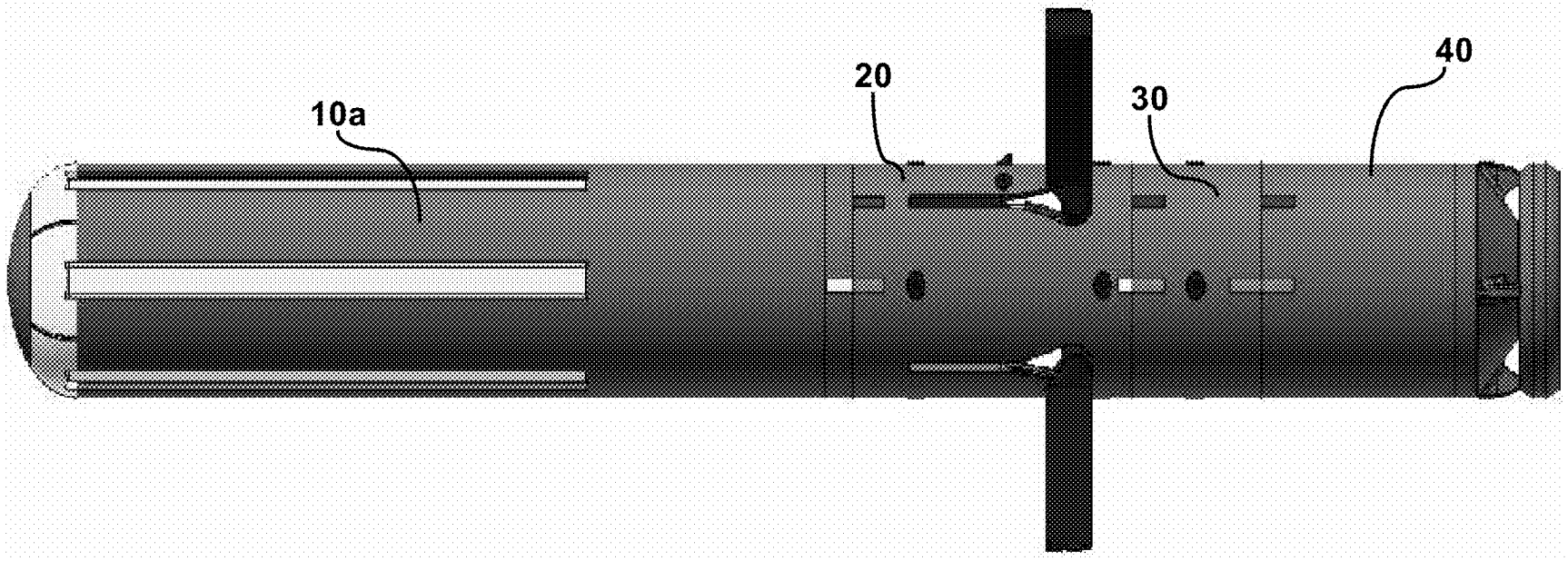
FIG. 7 is an isometric view of an exemplary torpedo apparatus having the fuel/oxidizer head of FIG. 5 attached, and showing the fins in the extended or deployed position.
Figure 8:
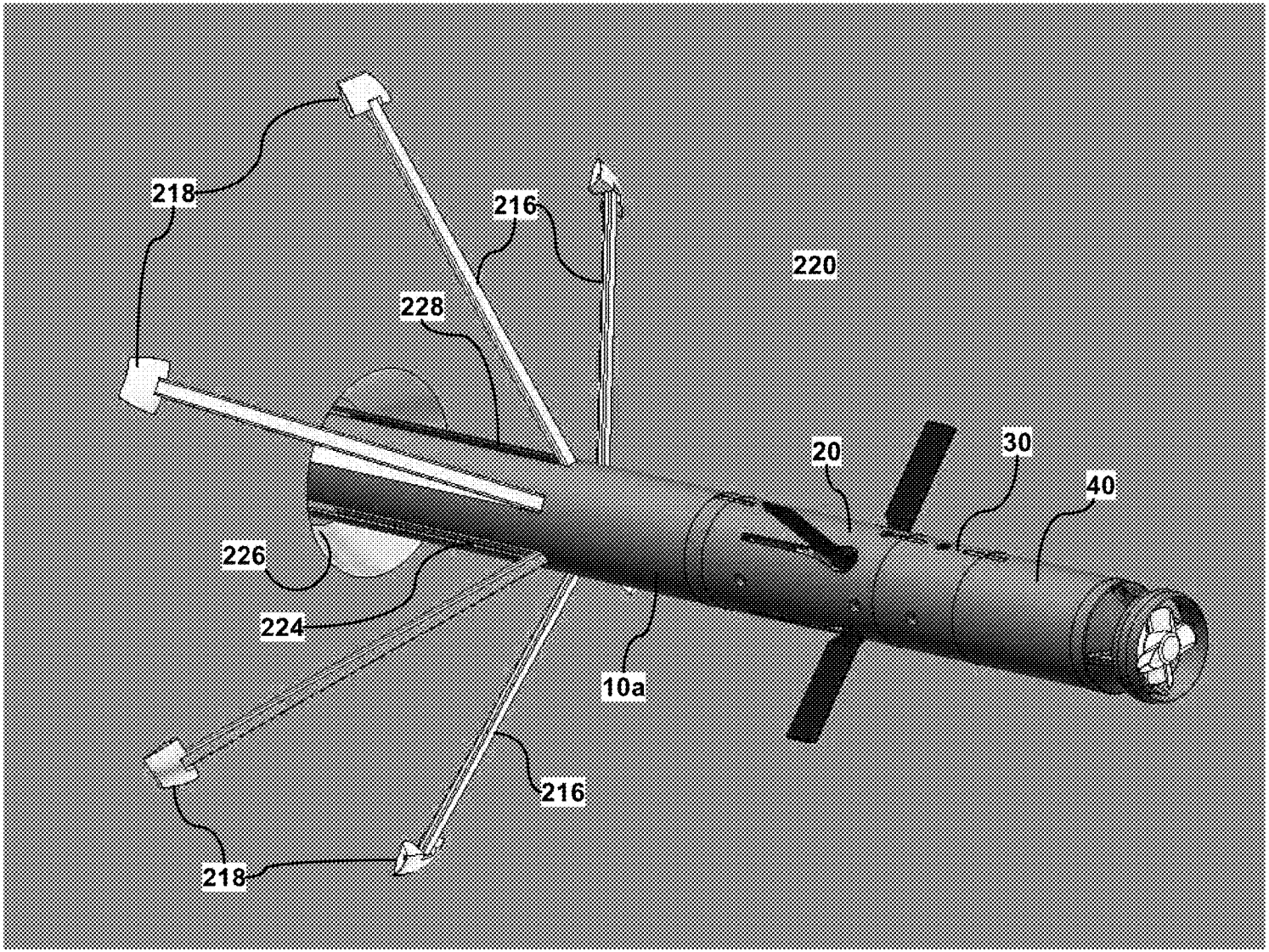
FIG. 8 is an isometric view of the torpedo apparatus of FIG. 7 in operation, and showing the legs attached to the hull of a vessel.

Referring now to FIGS. 5-8, there is shown an interchangeable torpedo head 10*a*, which includes a housing enclosing a piston 210 carrying an elongate charge of a fuel/oxidizer mixture 212 such as a thermite mixture. A heat-producing component 214 such as an incendiary charge, detonator, or the like, is provided to generate sufficient heat/temperature to initiate the thermite reaction. A plurality of legs 216 are hingedly attached to the piston 210 and are folded into slots or receptacles 224 in the module housing. The distal ends 218 of the legs each include a fastener element. Upon impact with the hull of a vessel, such as a ship, submarine, or other watercraft, the legs are deployed and the fastener elements are secured to the hull. In preferred embodiments, the fastener elements are permanent magnets, preferably powerful magnets such as rare earth (e.g., neodymium) magnets, for attachment to a hull 220 formed of iron, steel, or other magnetically attractive material. In the event of a nonmetal hull such as a wood or fiberglass hull, fasteners such as darts, hooks, or other mechanical fasteners are contemplated.

In operation, a guidance assembly or system, e.g., as detailed above, guides the torpedo toward a desired position on a target vessel. In certain embodiments, the guidance is effected by preprogrammed control. In certain embodiments, the torpedo head 10*a* includes a homing or seeker module as described herein for steering the torpedo to a desired location. Impact of the torpedo head with the vessel's hull ignites the charge 214 and initiates the fuel/oxidizer (e.g., thermite) reaction. The legs attached to the hull serve to focus the intense heat generated by the fuel/oxidizer reaction onto a single spot on the vessel's hull to produce a temperature which is sufficiently high to melt or otherwise breech the hull. As the fuel/oxidizer mixture is consumed and/or the torpedo head penetrates the hull, a spring 222, such as a coil spring, urges the piston carrying the elongate fuel/oxidizer charge towards the vessel's hull. As a hole 226 is formed in the vessel's hull by melting of the hull material, and as the hole continues to deepen, the spring urges the thermite material into the hole to continue the hull melting/breeching process until the thermite material 214 is consumed.

It will be recognized that the torpedo head functions identified above are illustrative and exemplary only and further torpedo heads are contemplated which include two or more functions or modules as described above. In preferred embodiments, each torpedo head includes at least one seeker assembly or function (e.g., laser seeker, magnetometer, or noise seeker) and at least one utility assembly or function (e.g., fuel/oxidizer breaching system or marker).

Referring again to FIGS. 1-4, the steering control module 20 includes a generally cylindrical outer shell receiving a plurality of fins 25 circumferentially spaced about the steering control module 20. The fins 25 can be folded into receptacles in the body of the steering control module 20 to allow the assembled system 10 to fit into a torpedo launch system 34. In certain embodiments, the torpedo diameter is 40 mm and is configured to be fired from existing 40 mm launch platforms, although in certain embodiments other sizes and/or custom or dedicated firing platforms are also contemplated. The steering control module 20 contains processing electronics, such as a computer processor, microprocessor, microcontroller, etc., to steer the torpedo toward the center of the designator beam marking the target object.

In certain embodiments, the steering control module 20 includes a steering control processor and an associated electronic memory operably coupled thereto for storage and execution of steering control instructions or algorithms, responsive to signals or instructions from the guidance system, e.g., optical or acoustic guidance system. In certain embodiments, the steering control module 20 includes an inertial navigation system (INS) that uses a computer system, motion sensors (e.g., accelerometers), and rotation sensors to continuously calculate the position, orientation, and velocity of the torpedo via dead reckoning. In certain embodiments, the steering control module 20 includes a receiver for receiving external positional references such as signals from a satellite based positioning system, such as GPS or the like. Certain embodiments may include a guidance computer and program instructions for autopilot operation and/or programmed steering control for control of the fins 25.

After firing, the fins can be moved to their extended position. In certain embodiments, one or more fin lock pins 27 unlock the fins 25 upon launch. Each of the fins 25 is independently controllable and may be rotated or tilted to provide maneuverability/steering control as well as stability of the sensing system during underwater travel. The fins 25 are sized to fit within the housing shell to allow the system 100 to fit within the constraints of the launch tube while providing the ability to allow the system 100 to perform steering maneuvers during travel. In certain embodiments, the fins are large enough to steer the torpedo system 100 around obstacles during travel. In certain embodiments, the fins 25 extend from apertures or receptacles 29 in the shell housing and may be actuated and controlled via springs, hydraulics, pneumatics, motors, and so forth under programmed control. In certain embodiments, the fins 25 are controlled responsive to a seeker module in the torpedo head 10 or other targeting system to direct or maintain the path of the torpedo 100 toward a target object such as a ship, submersible vessel, or other watercraft. In certain embodiments, the fins 25 are controlled in accordance with a preprogrammed travel path or sequence of movements. In certain embodiments, the fins 25 are controlled in accordance with a preprogrammed target location. In certain embodiments, the fins 25 are controlled in accordance with signals from a seeker or homing function on the torpedo head 10.

The battery module 30 includes a battery power system as would be generally known in the art. In certain embodiments, the battery module may be interchangeable to accommodate batteries or battery packs of different sizes, as needed. For example, the battery size may be selected to be commensurate with the distance the torpedo may be required to travel, e.g., wherein a larger battery is provided where the torpedo is expected to travel a greater distance. In certain embodiment, the battery module is electrically coupled via conductors and connectors to supply the electrical power requirements of the head module 10, the steering control module 20, and the propulsion module 40.

The propulsion module 40 includes a one or more propellers 42 for propulsion of the torpedo system, as would be generally known to persons skilled in the art.

The housing shells, fins, etc., of the present system may be formed of any suitable materials, including metals and metal alloys, composite materials comprising a fiber reinforced polymer materials, and the like.

In the exemplary embodiments shown herein, the rear portion of the module 10 is connected to the front portion of the steering control module 20 via complimentary fasteners. The rear portion of the module 20 is connected to the front portion of the battery module 30 via complimentary fasteners. Likewise, the rear portion of the battery module 30, in turn, is connected to the front portion of the propulsion module 40 via complimentary fasteners. In certain embodiments, the complimentary fasteners include mating cam lock mechanisms on adjoining sections. Alternatively, the fasteners connecting module 10 to module 20, module 20 to module 30, and/or module 30 to module 40 include bayonet type connectors. Electrical connectors and conductive pathways may be provided on the module housing sections to allow for power, signals, and data to be transmitted between the electronics within the steering control module 20 and the head module 10. In certain embodiments, the interlocking fastening mechanisms of adjacent sections are sized or otherwise geometrically configured to prevent attachment of modules in an incorrect or inoperative configuration or combination. Fiducial markings or indicia may be provided on the housing shells to visually indicate proper alignment and attachment.

The invention has been described with reference to the preferred embodiments. Modifications and alterations will occur to others upon reading and understanding the preceding detailed description. It is intended that the invention be construed as including all such modifications and alterations insofar as they come within the scope of the appended claims and equivalents thereof.

The invention claimed is:

1. A torpedo apparatus, comprising:

a propulsion module operable to propel the torpedo apparatus through water;

a steering module operatively coupled to the propulsion module, the steering module including a plurality of fins which are controllable for controlling a direction of travel of the torpedo apparatus through water;

a plurality of head modules removably and interchangeably attachable to the torpedo apparatus, wherein each of the head modules houses at least one guidance assembly and at least one utility assembly; and a power supply module configured to provide power to the propulsion module, the steering module, and an attached one of the head modules;

wherein one of the head modules includes a utility assembly comprising:

a housing enclosing a piston, the piston carrying an elongate charge of fuel/oxidizer mixture;

a heat-producing component attached to the charge of a fuel/oxidizer mixture and configured to generate sufficient heat to initiate a fuel/oxidizer reaction upon impact with a vessel's hull;

a plurality of legs, each of the legs having a proximal end hingedly attached to the piston and a distal end opposite the proximal end, each of the legs movable between a retracted position and an extended position;

the distal end of each leg having a fastener element operable to attach to the vessel's hull upon impact with the vessel's hull; and a spring disposed within the housing for biasing the piston toward the vessel's hull upon impact with and attachment to the vessel's hull.

2. The torpedo apparatus of claim 1, wherein the guidance assembly includes an optical receiver for detecting light reflected from a target, the optical receiver cooperating with the steering module to direct the torpedo apparatus to the target.

3. The torpedo apparatus of claim 2, wherein the guidance assembly is configured to follow an ultraviolet (UV) laser designator beam.

4. The torpedo apparatus of claim 1, wherein the guidance assembly includes an acoustic transducer for detecting sound waves emanating from a target, the acoustic transducer cooperating with the steering module to direct the torpedo apparatus to the target.

5. The torpedo apparatus of claim 4, wherein the guidance assembly is configured to emit pulses of sound and detect return echoes.

6. The torpedo apparatus of claim 4, wherein the pulses of sound have an ultrasonic frequency.

7. The torpedo apparatus of claim 1, wherein the guidance assembly includes a magnetometer configured to detect variations in the Earth's magnetic field caused by a target, the magnetometer cooperating with the steering module to direct the torpedo apparatus to the target.

8. The torpedo apparatus of claim 1, wherein the utility assembly includes a tracking device and a fastener for attaching the tracking device to a target vessel.

9. The torpedo apparatus of claim 8, wherein the fastener is selected from the group consisting of one or more magnets, one or more darts, and one or hooks.

10. The torpedo apparatus of claim 8, wherein the tracking device is selected from the group consisting of a radio frequency beacon, optical beacon, inertial device and a satellite-based positioning system tracking device.

11. The torpedo apparatus of claim 1, wherein said fins are movable between a retracted state wherein the fins are retracted within a housing of the steering module and an extended state wherein the fins extend through openings within the housing of the steering module.

12. The torpedo apparatus of claim 1, wherein the torpedo apparatus is configured to fit into a conventional torpedo launch platform from which the torpedo apparatus can be launched.

13. The torpedo apparatus of claim 12, wherein the conventional torpedo launch platform is a 40 mm launch platform.

14. The torpedo apparatus of claim 1, wherein the fuel/oxidizer mixture is thermite.

15. The torpedo apparatus of claim 1, wherein the heat-producing component is selected from the group consisting of an incendiary charge and a detonator.

16. The torpedo apparatus of claim 1, wherein each leg is folded into a respective receptacle in the housing when the legs are in the folded position.

17. The torpedo apparatus of claim 1, wherein the fastener elements are selected from group consisting of permanent magnets, darts, and hooks.

* * * * *